US012622550B2

(12) United States Patent
Anderson

(10) Patent No.: US 12,622,550 B2
(45) Date of Patent: May 12, 2026

(54) SHOWER CURTAIN WITH ASSISTANCE PANEL

(71) Applicant: Leslie Dawn Anderson, Poplar Bluff, MO (US)

(72) Inventor: Leslie Dawn Anderson, Poplar Bluff, MO (US)

( * ) Notice: Subject to any disclaimer, the term of this patent is extended or adjusted under 35 U.S.C. 154(b) by 71 days.

(21) Appl. No.: 18/668,335

(22) Filed: May 20, 2024

(65) Prior Publication Data

US 2025/0352005 A1 Nov. 20, 2025

(51) Int. Cl.
*A47K 3/38* (2006.01)

(52) U.S. Cl.
CPC ..... *A47K 3/38* (2013.01)

(58) Field of Classification Search
CPC ..... A47K 3/38
See application file for complete search history.

(56) References Cited

U.S. PATENT DOCUMENTS 6,336,232 B1 * 1/2002 Toder ..... A47K 3/38 4/558
7,761,935 B1 * 7/2010 Whitaker ..... A47K 3/38 4/558
8,719,974 B2 5/2014 Empey
11,547,249 B2 1/2023 Savino
2007/0199143 A1 8/2007 Cunningham et al.
2010/0222725 A1 * 9/2010 Munzel ..... A47K 3/38 602/3
2011/0099710 A1 * 5/2011 Whitmore ..... A47K 3/38 83/13
2011/0258768 A1 10/2011 Spingola et al.
2023/0008415 A1 * 1/2023 Charlton ..... A47K 3/38

* cited by examiner

*Primary Examiner* — Janie M Loeppke
(74) *Attorney, Agent, or Firm* — Brian P. Klein; Fast Forward Law, LLC

(57) ABSTRACT

A shower curtain for use in an area including a shower that includes a shower space sized for receiving a subject for showering and a dry space outside the shower space. The shower curtain comprises a sheet adapted to hang between the shower space and the dry space to limit water exiting the shower space and entering the dry space. The sheet has an opening sized and shaped to permit an assistant positioned in the dry space to reach through the opening into the shower space to assist the subject. The shower curtain includes a panel attached to the sheet selectively movable between a closed position in which the panel covers the opening to limit water exiting the shower space through the opening and an open position in which the opening is accessible by the assistant to reach into the shower space to assist the subject.

20 Claims, 4 Drawing Sheets

SHOWER CURTAIN WITH ASSISTANCE PANEL

BACKGROUND OF THE INVENTION

The present disclosure is directed to a shower curtain, and more particularly to a shower curtain including an assistance panel allowing an assistant to reach through the shower curtain to assist a subject in showering.

Conventional shower curtains hang from rods in bathrooms between a shower space and a dry space to limit water from leaving the shower space and entering the dry space. For persons who are able to shower without assistance, conventional shower curtains work well, allowing the subject to shower without concern about large amounts of water entering the dry space outside the shower space because the curtain limits water from leaving the shower space. But with a subject who needs assistance showering, such as a child, a patient, a person with a disability or medical condition, or a pet, conventional shower curtains have substantial drawbacks. When fully extended the shower curtain prevents most water from leaving the shower space, but an assistant cannot help the subject with showering. To assist with showering, the assistant sometimes slides the shower curtain open at one end allowing them to reach into the shower to help the subject. But with the shower curtain opened, even partially, water readily leaves the shower space and flows into the dry space of the bathroom. This often results in both the assistant and the dry space becoming wet due to shower overspray. Water also enters the dry space due to a child splashing or a pet shaking or deciding to leave the shower area altogether without a curtain acting as a mental and physical barrier.

Shower assistance is commonly needed in settings, such as at home, in a hospital, in a skilled care facility, in a rehabilitation unit, or in any facility where assisted showering may occur. Moreover, with the shower curtain open, the shower space can become cold as cool air from the dry space of the bathroom flows into the shower space and air warmed by the shower flows out of the shower space into the dry space. This movement of air can make the subject in the shower cold and uncomfortable, making assistance more difficult, and prolonging the shower.

Using a conventional shower curtain when an assistant is needed leads to more water entering the dry space. This causes several problems, including the time and cost associated with cleaning up the dry space, the increased chance of an assistant or subject falling in the dry space due to a wet floor, and an increased need for the assistant to change out of wet clothes or endure damp clothes after a shower assist. With a conventional shower curtain, facilities providing assisted showers and the assistants often need to purchase and launder additional towels to soak up water, purchase and use shoe covers to protect shoes from water damage, purchase and use waterproof clothing protectors (e.g., a disposable gown) to protect clothes from water, and use additional energy to heat showering spaces due to heat loss when the curtain is open.

In view of the drawbacks discussed above, there remains a need for an improved alternative shower curtain adapted for assistance that (i) limits water leaving the shower space, (ii) minimizes cold air entering the shower space, (iii) allows the caregiver to remain dry, (iv) uses fewer towels for cleanup of the dry space, and (v) permits the shower curtain to remain in place both when assistance is needed and for everyday use when shower assistance is not needed.

SUMMARY

In one aspect, the present disclosure includes a shower curtain for use in an area including a shower. The area includes a shower space sized for receiving a subject for showering and a dry space outside the shower space. The shower curtain comprises a sheet adapted to hang between the shower space and the dry space to limit water exiting the shower space and entering the dry space. The sheet has an opening sized and shaped to permit an assistant positioned in the dry space to reach through the opening into the shower space to assist the subject. A panel attaches to the sheet. The panel is selectively movable between a closed position in which the panel covers the opening to limit water exiting the shower space through the opening and an open position in which the opening is accessible by the assistant to reach into the shower space to assist the subject. The panel is selectively retained in the closed position and the open position.

In another aspect, the present disclosure includes a method for using a shower curtain adapted to assist in showering for use in an area including a shower, the area including a shower space sized for receiving a subject for showering and a dry space outside the shower space. The shower curtain comprises a sheet adapted to hang between the shower space and the dry space to limit water exiting the shower space and entering the dry space. The sheet has an opening sized and shaped to permit an assistant positioned in the dry space to reach through the opening into the shower space to assist the subject. The shower curtain comprises a panel attached to the sheet. The panel is selectively movable between a closed position in which the panel covers the opening to limit water exiting the shower space through the opening and an open position in which the opening is accessible by the assistant to reach into the shower space to assist the subject. The panel is selectively retained in the closed position and the open position. With this type of shower curtain, the method comprises guiding the subject from the dry space and into the shower space. The method further comprises positioning the shower curtain to hang between the shower space and the dry space with the panel selectively retained in the closed position. The method also comprises extending an arm around the shower curtain to turn on the water in the shower space. The method further comprises moving the panel from the closed position to the open position and reaching through the opening into the shower space to assist the subject with showering. The method also comprises moving the panel from the open position to the closed position and extending an arm around the shower curtain to turn off the water in the shower space. The method further comprises repositioning the shower curtain to allow movement between the shower space and the dry space and guiding the subject from the shower space and into the dry space.

Other aspects of the present disclosure will be apparent in view of the following description and claims.

BRIEF DESCRIPTION OF DRAWINGS

This disclosure includes non-limiting examples illustrated in the accompanying drawings.

Corresponding reference characters indicate corresponding parts throughout the drawings.

DETAILED DESCRIPTION

Figure 1:
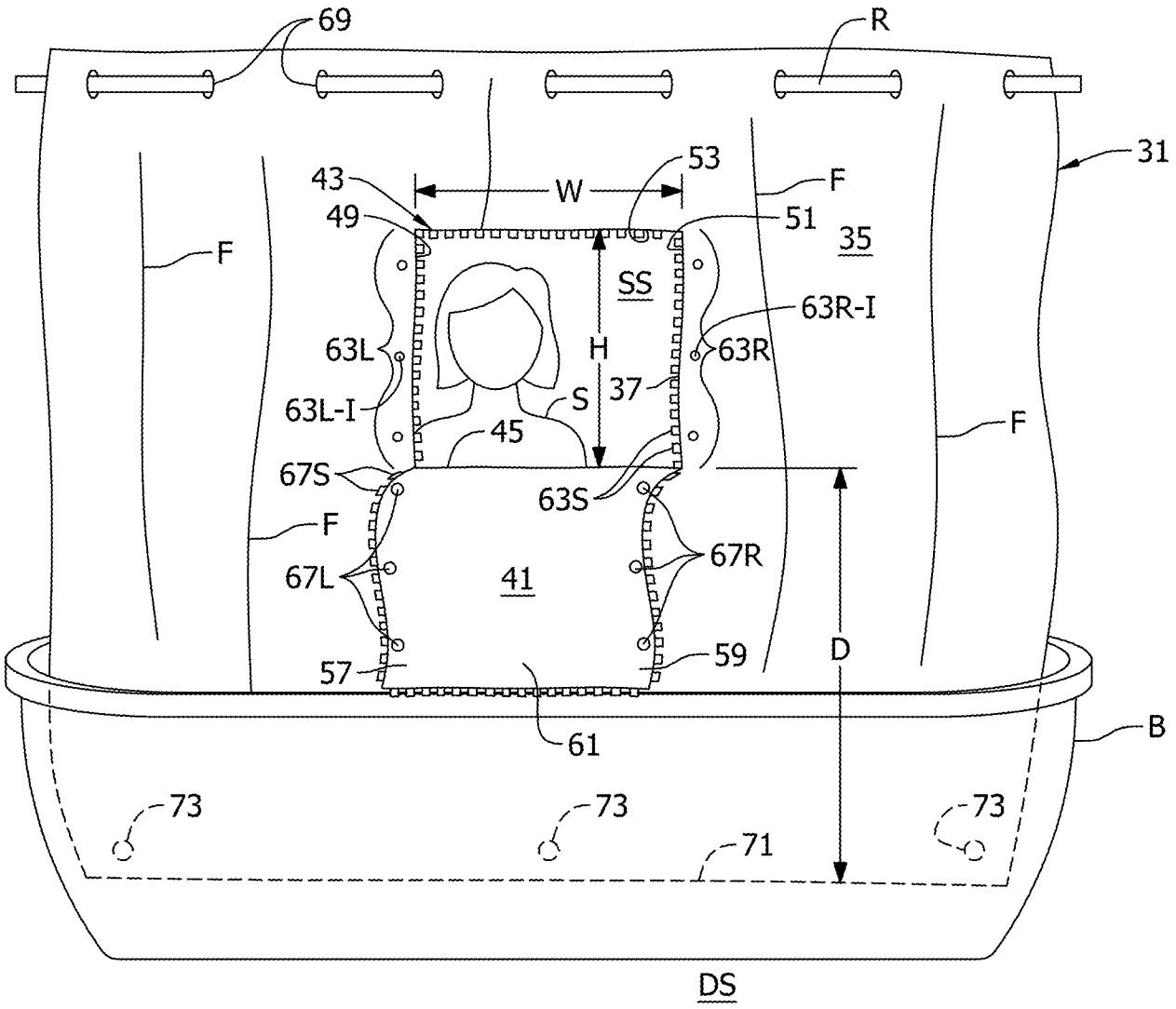
FIG. 1 is a front elevation of a first example of a shower curtain with assistance panel.
Figure 2:
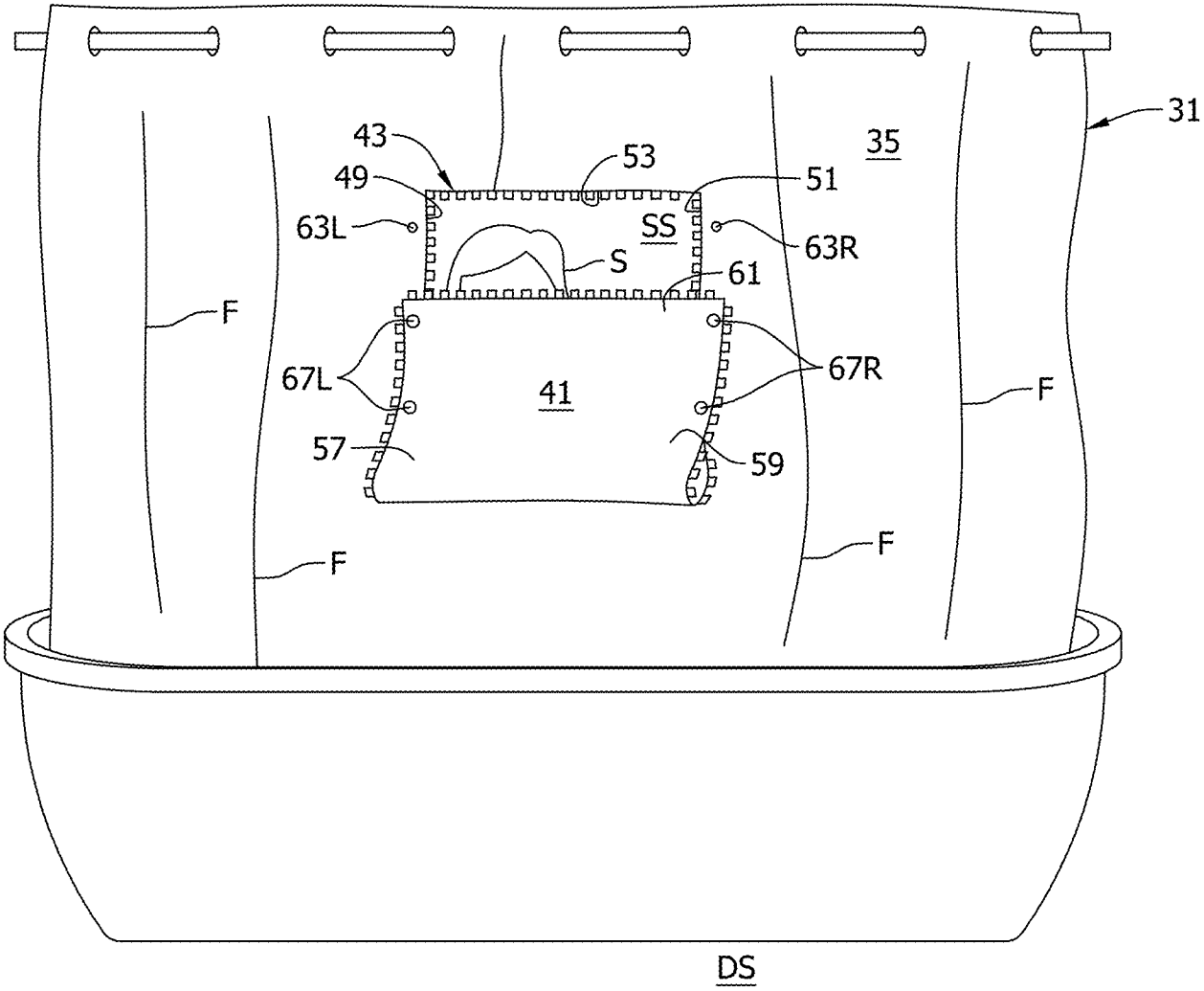
FIG. 2 is a front elevation of the first example shown with the panel retained in an intermediate position.

As shown in FIGS. 1 and 2, a shower curtain for use in assisting another person or pet with showering is designated in its entirety by the reference number 31. The shower curtain 31 is designed for use in an area having a shower. The area includes a shower space SS sized and shaped to receive a subject S to shower and a dry space DS outside the shower space. The shower curtain 31 comprises a sheet 35 adapted to hang between the shower space SS and the dry space DS to limit water leaving the shower space SS and entering the dry space DS. The sheet 35 has an opening 37 sized and shaped to permit an assistant (not shown) positioned in the dry space DS to reach through the opening into the shower space SS to assist the subject S with showering.

The shower curtain 31 includes a panel 41 attached to the sheet 35. The panel 41 is selectively movable between a closed position (e.g., shower curtain 131 of FIG. 3) in which the panel covers the opening 37 to limit water exiting the shower space SS through the opening and an open position (see FIG. 1) in which the opening is accessible by the assistant to reach into the shower space to assist the subject S. The panel 41 is adapted to be selectively positioned and retained in the closed position and the open position as will be explained. The panel 41 is pivotably attached to the sheet 35 permitting the panel to pivot relative to the sheet when moving the panel between the closed position and the open position.

Although it is envisioned that the opening 37 and panel 41 of the shower curtain 31 may have other shapes such as oval, square, or circular, among others, the illustrated shower curtain includes an opening and a panel that is generally rectangular. The opening 37 is defined by an edge, generally indicated by 43, surrounding the opening including a lower portion 45 of the edge 43 extending adjacent to a bottom of the opening. The panel 41 is pivotably attached to the sheet 35 adjacent to the lower portion 45 of the edge 43. The pivotable attachment permits the panel 41 to pivot outward from the shower space SS toward the assistant and into the dry space DS (see FIG. 1). The panel 41 may also pivot inward (not shown) toward the subject S and into the shower space SS, but this inward pivot permits both sides of the panel to be exposed to water within the shower space, bringing unwanted water toward the dry space DS when returning the panel to the closed position.

The edge 43 defining the opening 37 includes a left portion 49 of the edge extending adjacent to a left side of the opening. The edge 43 also includes a right portion 51 of the edge 43 opposite the left portion 49 of the edge 43 extending adjacent to a right side of the opening 37. The edge 43 also includes an upper portion 53 of the edge 43 extending adjacent to a top of the opening. The panel 41 includes a left margin 57, a right margin 59 opposite the left margin, and a free margin 61.

The shower curtain 31 also includes a plurality of fastener connectors 63 divided into a left group of the plurality of fastener connectors 63L and a right group of the plurality of fastener connectors 63R. The left group of the plurality of fastener connectors 63L is positioned on the sheet 35 adjacent to the left portion 49 of the edge 43. The right group of the plurality of fastener connectors 63R is positioned on the sheet 35 adjacent to the right portion 51 of the edge 43.

The shower curtain 31 also includes a plurality of fasteners 67. The plurality of fasteners is divided into a left group of the plurality of fasteners 67L and a right group of the plurality of fasteners 67R. The left group of the plurality of fasteners 67L is positioned in the left margin 57 of the panel 41 to fasten the left margin of the panel adjacent to the left portion 49 of the edge 43. The right group of the plurality of fasteners 67R is positioned in the right margin 59 of the panel 41 to fasten the right margin of the panel adjacent to the right portion 51 of the edge 43 defining the opening 37.

Each fastener 67 is adapted to connect to each fastener connector 63. Although the fasteners 67 and fastener connectors 63 of the shower curtain 31 may include other types of fasteners (e.g., snaps, buttons, hook and loop fasteners, eyelets, buckles, snaps, etc.), each illustrated fastener connector 63 comprises a female magnetic button, and each illustrated fastener 67 comprises a male magnetic button. When fastened, the left margin 57 and the right margin 59 of the panel 41 overlap the left portion 49 of the edge 43 and the right portion 51 of the edge, respectively. The illustrated panel 41 and opening 37 are the same size, but because the shower curtain 31 hangs with some vertical folds F along its width and is not taut, the folds in the shower curtain allow the panel to close the opening without stretching or pulling the panel to fasten it over the opening. Rather, the extra folds of material in the shower curtain 31 allow the panel 41 to be securable over the opening 37 in the closed position with each of the plurality of fasteners 67 fastened to the respective plurality of fastener connectors 63.

The left group of the plurality of fastener connectors 63L includes an intermediate fastener connector 63L-I positioned on the sheet 35 adjacent to the left portion 49 of the edge 43 and located between the upper portion 53 of the edge and the lower portion 45 of the edge. The right group of the plurality of fastener connectors 63R includes an intermediate fastener connector 63R-I positioned on the sheet 35 adjacent to the right portion 51 of the edge 43 and located between the upper portion 53 of the edge and the lower portion 45 of the edge. The panel 41 is selectively movable to and retained in an intermediate position (see, e.g., FIG. 2) in which the panel partially covers the opening 37 to limit water exiting the shower space SS through the opening by fastening the fasteners 67L, 67R adjacent to the end margin 61 to the intermediate fastener connectors 63L-I, 63R-I, respectively. More generally, by selecting the pair of horizontally opposed fastener connectors 63L, 63R fastened to the respective fasteners 67L, 67R adjacent to the end margin 61, the assistant can selectively move the panel to the closed position, the intermediate position, or a low position in which the fasteners are joined to the horizontally opposed fastener connectors nearest the lower portion 45 of the edge 43. As should be understood by one skilled in the art, any number of partially open positions may be created by altering the vertical positions of the plurality of fastener connectors 63L, 63R. Further, different numbers and spacings of fasteners 67 and fastener connectors 63 are contemplated.

In another example, each fastener connector 63 comprises a slide fastener connector 63S and each fastener 67 comprises a slide fastener 67S. The slide fastener connector 63S and slide fastener 67S may form a conventional zipper, permitting the opening 37 to be closed so the shower curtain 31 can be used in a traditional manner to shower without assistance. Because the shower curtain 31 may be used with or without assistance, it may remain closed during use with or without assistance. The zipper, the male magnetic buttons, and the female magnetic buttons are configured to be included on a single shower curtain 31, although it is envisioned that the zipper and magnetic buttons would not be used simultaneously. The assistant can choose to secure the panel 41 in the closed position by zipping the panel over the opening 37 or by engaging the male and female magnetic buttons. Alternately, a shower curtain 31 may include either the zipper or the male and female magnetic buttons.

Returning to FIG. 1, the illustrated shower curtain 31 hangs from a rod R passing through holes 69 in the sheet 35 or by rings passed through holes near a top of the curtain (not shown). Although the components of the shower curtain 31 described above may have other dimensions to facilitate use by a particular subject S and assistant in a particular shower space SS and dry space DS, the illustrated shower curtain 31 opening 37 has a width W of about 20 inches to about 30 inches and a height H of about 20 inches to about 30 inches. More specifically, the illustrated curtain 31 has a width W of about 24 inches and a height H of about 24 inches. The sheet 35 of the shower curtain 31 includes a bottom end 71. The lower portion 45 of the edge 43 is spaced from the bottom end 71 by a distance D of about 25 inches to about 35 inches. More specifically, the distance D of the illustrated shower curtain 31 is about 28 inches to about 32 inches. As should be understood by one skilled in the art, the shower space SS is defined by a bathtub B comprising a ferromagnetic material. The sheet 35 further comprises a plurality of magnets 73 adapted to releasably secure the bottom end 71 of the sheet to the bathtub B.

Figure 3:
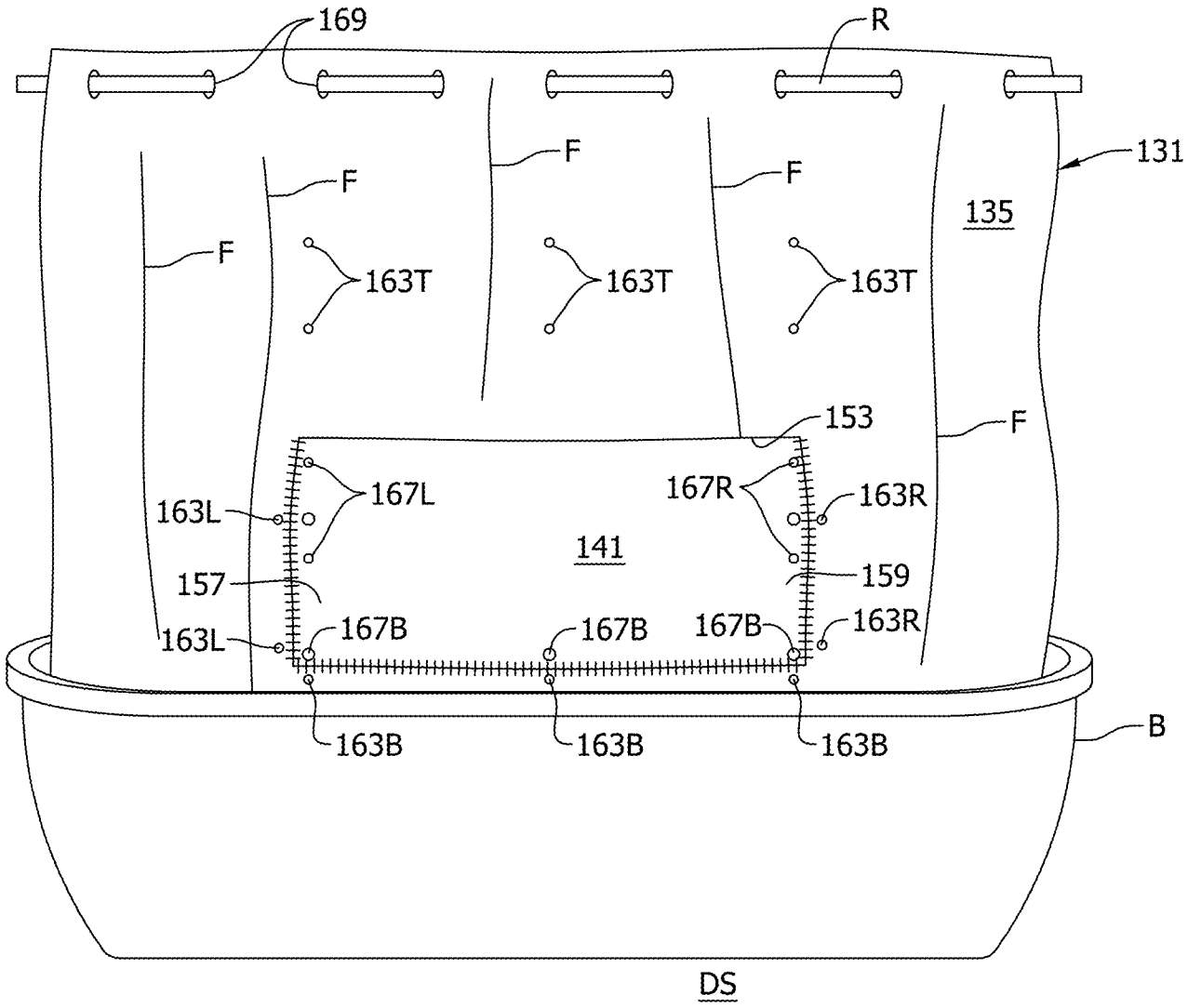
FIG. 3 is a front elevation of a second example of a shower curtain with assistance panel.
Figure 4:
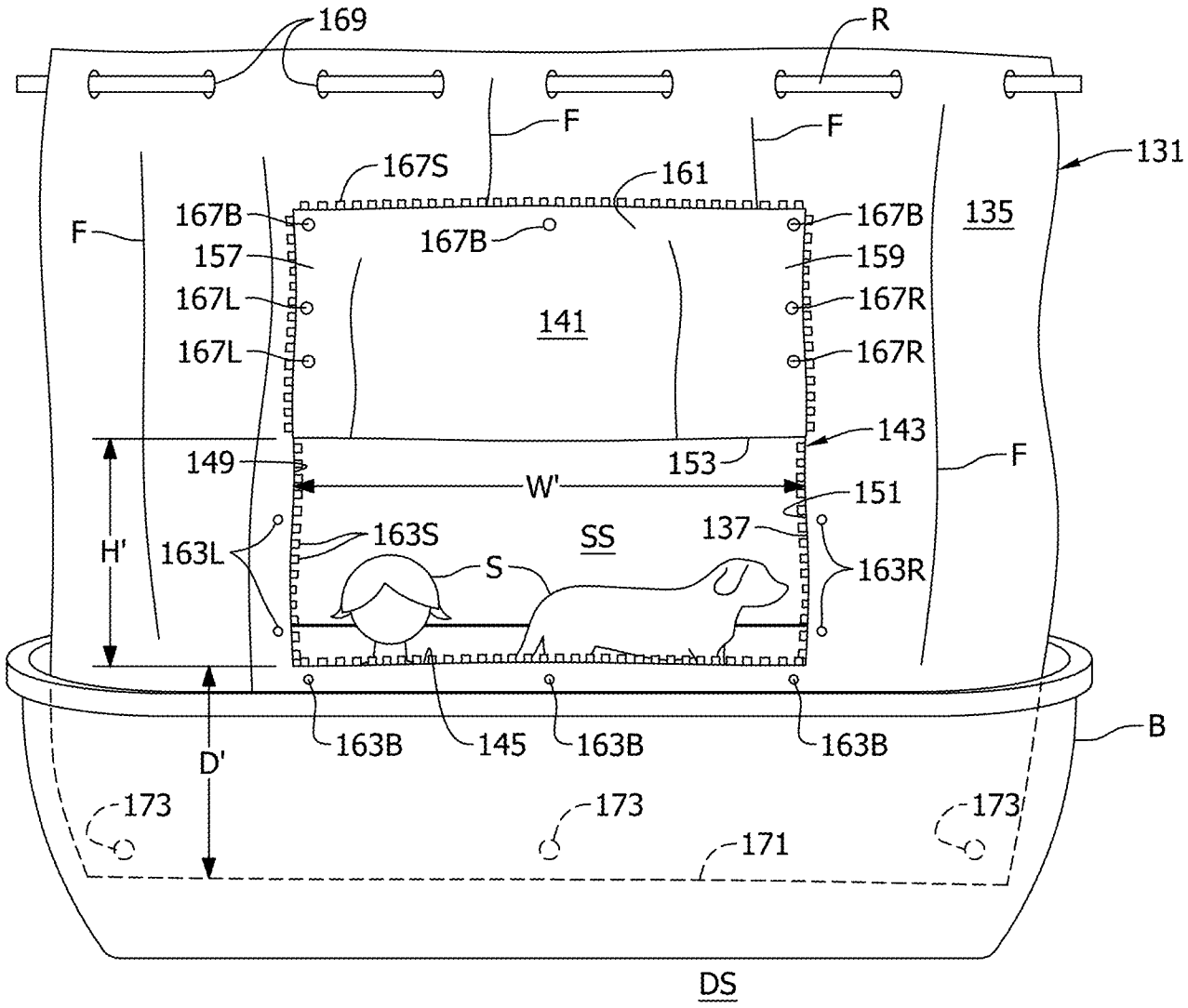
FIG. 4 is a front elevation of the second example shown with the panel retained in an open position.

Turning to FIGS. 3 and 4, a second example of a shower curtain to be used in assisting another person or pet with showering is designated in its entirety by the reference number 131. As with the first example, the shower curtain 131 includes a sheet 135 having an opening 137 and a panel 141 attached to the sheet. The opening 137 is defined by an edge, generally indicated by 143, surrounding the opening having an upper portion 153 of the edge 143 extending adjacent to a top of the opening. The panel 141 is pivotably attached to the sheet 135 adjacent to the upper portion 153 of the edge 143. The edge 143 defining the opening 137 also includes a left portion 149 of the edge 143 extending adjacent to a left side of the opening and a right portion 151 of the edge 143 opposite the left portion of the edge extending adjacent to a right side of the opening. The panel 141 includes a left margin 157 and a right margin 159 opposite the left margin. The shower curtain 131 includes a plurality of fastener connectors 163. The plurality of fastener connectors 163 is divided into a left group of the plurality of fastener connectors 163L positioned on the sheet 135 adjacent to the left portion 149 of the edge 143 and a right group of the plurality of fastener connectors 163R positioned on the sheet adjacent to the right portion 151 of the edge. The shower curtain 131 includes a plurality of fasteners 167. The plurality of fasteners is divided into a left group of fasteners 167L and a right group of fasteners 167R. The left group of fasteners 167L is positioned in the left margin 157 of the panel 141 to fasten the left margin of the panel adjacent to the left portion 149 of the edge 143 defining the opening 137. The right group of fasteners 167R is positioned in the right margin 159 of the panel 141 to fasten the right margin of the panel adjacent to the right portion 151 of the edge 143. The edge 151 also includes a lower portion 145 of the edge 143 extending adjacent to a bottom of the opening. The panel 141 also includes a free margin 161. In the illustrated example, each fastener 167 is adapted to connect to each fastener connector 163. Although the fastener 167 and fastener connectors 163 of the shower curtain 131 may be fastened using other types of fasteners (e.g., snaps, buttons, hook and loop fasteners, eyelets, buckles, snaps, etc.), each fastener connector 163 of the illustrated example comprises a female magnetic button, and each fastener 167 of the illustrated example comprises a male magnetic button.

The plurality of fasteners 167 is divided into a left group of fasteners 167L, a right group of fasteners 167R, and a bottom group of fasteners 167B positioned in the free margin 161 of the panel 141. The plurality of fastener connectors 163 is divided into a left group of fastener connectors 163L, a right group of fastener connectors 163R, a bottom group of fastener connectors 163B positioned on the sheet 135 adjacent to the lower portion 145 of the edge 143, and a top group of fastener connectors 163T positioned on the sheet 135 above the upper portion 153 of the edge 143. The panel 141 is selectively retainable in an open position by fastening the bottom group of fasteners 167B to the top group of fastener connectors 163T. The panel 141 is selectively retainable in a fully open position by fastening the bottom group of fasteners 167B to the highest three of the top group of fastener connectors 163T (see FIG. 4). Alternately, the panel 141 is selectively retainable in a partially open position by fastening the bottom group of fasteners 167B to the lowest three of the top group of fastener connectors 163T (not shown). As should be understood by one skilled in the art, any number of partially open positions may be created by altering the vertical positions of the top group of fastener connectors 163T. Further, different numbers and spacings of fasteners 167 and fastener connectors 163 are contemplated.

In another example, each fastener connector 163 comprises a slide fastener connector 163S, and each fastener 167 comprises a slide fastener 167S. The slide fastener connector 163S and slide fastener 167S form a conventional zipper. The zipper permits the opening 137 to be closed so the shower curtain 131 may be used in a traditional manner to shower without assistance. Accordingly, the shower curtain 131 may be used with or without assistance as needed. The zipper, the male magnetic buttons, and the female magnetic buttons may be included in one curtain 131, but it is envisioned that the zipper and magnetic buttons will not be used simultaneously. The assistant can choose to secure the panel 141 in the closed position by zipping the panel over the opening 137 or by engaging the male and female magnetic buttons. Alternately, a shower curtain 131 may include only the zipper or only the male and female magnetic buttons.

The shower curtain 131 of the illustrated example hangs like a conventional shower curtain from a rod R passing through holes 169 in the sheet 135 or by rings or other holders passed through holes near a top of the curtain (not shown). Although the components of the shower curtain 131 described above may be other dimension facilitating use by a particular subject S and assistant in a particular shower space SS and dry space DS, the illustrated shower curtain 131 opening 137 has a width W' of about 30 inches to about 40 inches and a height H' of about 20 inches to about 30 inches. More specifically, the illustrated curtain 131 has a width W' of about 36 inches and a height H' of about 24 inches. The sheet 135 of the shower curtain 131 includes a bottom end 171. The lower portion 145 of the edge 143 is spaced from the bottom end 171 by a distance D' of about 10 inches to about 29 inches. More specifically, in the illustrated example, the distance D' is about 12 inches to about 16 inches. As should be understood by one skilled in the art, the shower space SS is defined by a bathtub B comprising a ferromagnetic material. The sheet 135 may include a plurality of magnets 173 adapted to hold the bottom end 171 of the sheet against the bathtub B.

The illustrated shower curtains 31, 131 comprise a waterproof fabric, such as a polyester or vinyl. Although the illustrated shower curtains 31, 131 comprise a polyester or vinyl, those skilled in the art will appreciate the shower curtains may be made from other suitable materials, making the shower curtains more durable and reusable. In addition, the thickness and coating of the shower curtains 31, 131 may be modified to alter the durability and reusability of the shower curtains. It is also contemplated that the shower curtains 31, 131 may be constructed of a single use material, such as a polyethylene, allowing the shower curtains to be used one time and then discarded, as may be useful in a setting where communicable diseases are an issue.

Referring to FIGS. 1 and 2, a method for using a shower curtain 31 adapted to assist in showering for use in an area including a shower is described. The area includes a shower space SS sized for receiving a subject S for showering and a dry space DS outside the shower space. The shower curtain 31 comprises a sheet 35 adapted to hang between the shower space SS and the dry space DS to limit water exiting the shower space SS and entering the dry space DS. The sheet 35 has an opening 37 sized and shaped to permit an assistant positioned in the dry space DS to reach through the opening 37 into the shower space SS to assist the subject S. The shower curtain 31 comprises a panel 41 attached to the sheet 35. The panel 41 is selectively movable between a closed position in which the panel covers the opening 37 to limit water exiting the shower space SS through the opening and an open position in which the opening is accessible by the assistant to reach into the shower space SS to assist the subject S. The panel 41 is selectively retained in the closed position and the open position. With this type of shower curtain 31, the method comprises guiding the subject S from the dry space DS and into the shower space SS. The method further comprises positioning the shower curtain 31 between the shower space SS and the dry space DS with the panel 41 selectively retained in the closed position. The method also comprises extending an arm around the shower curtain 31 to turn on the water in the shower space SS. The method further comprises moving the panel 41 from the closed position to the open position and reaching through the opening 37 into the shower space SS to assist the subject S with showering. The method also comprises moving the panel 41 from the open position to the closed position and extending an arm around the shower curtain 31 to turn off the water in the shower space SS. The method further comprises repositioning the shower curtain 31 to allow movement between the shower space SS and the dry space DS and guiding the subject S from the shower space and into the dry space.

Use of this improved shower curtain can decrease the time and cost associated with cleanup of the dry space. These costs are substantially reduced or eliminated by using the shower curtain described herein. The shower curtain described herein (i) limits water leaving the shower space, (ii) minimizes cold air entering the shower space, (iii) allows the caregiver to remain dry, (iv) uses fewer towels for cleanup of the dry space, and (v) permits the shower curtain to remain in place both when assistance is needed and for everyday use when shower assistance is not needed.

As various changes could be made to the constructions and methods described herein, it is intended that all matter contained in the above description or shown in the accompanying drawings shall be interpreted as illustrative and not in a limiting sense. The patentable scope of the disclosure is defined by the claims, and can include other constructions and methods that would occur to those skilled in the art. Such other constructions are intended to be within the scope of the claims if the structural elements of the constructions do not differ from the literal language of the claims, or if the constructions include equivalent structural elements having insubstantial differences from the literal languages of the claims.

To the extent that the specification, including the claims and accompanying drawing, discloses any additional subject matter that is not within the scope of the claims below, the disclosures are not dedicated to the public and the right to file one or more applications to claims such additional disclosures is reserved.

When introducing in this description and the claims, the articles "a", "an", "the", and "said" are intended to mean that there are one or more of the elements. The terms "comprising", "including", and "having" are intended to be inclusive and mean that there may be additional elements other than the listed elements.

The invention claimed is:

1. A shower curtain for use in an area including a shower, said area including a shower space sized for receiving a subject for showering and a dry space outside the shower space, said shower curtain comprising:

a sheet adapted to hang between the shower space and the dry space to limit water entering the dry space from the shower space, the sheet including a foot end and an opening defined by an edge, the opening being sized and shaped to permit an assistant positioned in the dry space to reach through the opening into the shower space to assist the subject, the edge including a lower edge portion extending along a bottom of the opening spaced from the foot end of the sheet by a distance of 10 inches to 29 inches; and a panel attached to the sheet, the panel being selectively movable between a closed position in which the panel covers the opening to limit water passing through the opening and an open position in which the opening is uncovered allowing the assistant to reach through the opening to assist the subject in the shower space, the panel being selectively retainable in the closed position and selectively retainable in the open position.

2. A shower curtain as set forth in claim 1 wherein the panel is pivotably attached to the sheet permitting the panel to pivot relative to the sheet when moving the panel between the closed position and the open position.

3. A shower curtain as set forth in claim 2 wherein the opening and the panel are generally rectangular.

4. A shower curtain as set forth in claim 1 wherein the lower edge portion is spaced from the foot end of the sheet by a distance of 12 inches to 16 inches.

5. A shower curtain as set forth in claim 3 wherein:

the edge defining the opening includes an upper edge portion extending along a top of the opening; and the panel is attached to the sheet adjacent to the upper edge portion.

6. A shower curtain as set forth in claim 5 wherein:

the edge defining the opening also includes a left edge portion extending along a left side of the opening and a right edge portion opposite the left edge portion extending along a right side of the opening;

the panel includes a left margin and a right margin opposite the left margin; and the shower curtain further comprises:

a plurality of fastener connectors divided into a left connector group positioned on the sheet adjacent to the left edge portion and a right connector group positioned on the sheet adjacent to the right edge portion;

a plurality of fasteners, each fastener of said plurality of fasteners being adapted to connect to each fastener connector of said plurality of fastener connectors, said plurality of fasteners being divided into a left fastener group positioned in the left margin of the panel to fasten the left margin of the panel to the sheet adjacent to the left edge portion and a right fastener group positioned in the right margin of the panel to fasten the right margin of the panel to the sheet adjacent to the right edge portion.

7. A shower curtain as set forth in claim 6 wherein:

each fastener connector of said plurality of fastener connectors comprises a female magnetic button; and each fastener of said plurality of fasteners comprises a male magnetic button.

8. A shower curtain as set forth in claim 5 wherein:

the edge defining the opening includes a left edge portion extending along a left side of the opening, a right edge portion opposite the left edge portion extending along a right side of the opening, and a lower edge portion extending along a bottom of the opening;

the panel includes an end margin; and the shower curtain further comprises:

a plurality of fastener connectors divided into a left connector group positioned on the sheet adjacent to the left edge portion, a right connector group positioned on the sheet adjacent to the right edge portion, a bottom connector group positioned on the sheet adjacent to the lower portion of the edge, and a top connector group positioned on the sheet above the upper portion of the edge; and a plurality of fasteners, each fastener of said plurality of fasteners being adapted to connect to each fastener connector of said plurality of fastener connectors, said plurality of fasteners being divided into a left fastener group positioned in the left margin of the panel to fasten the left margin of the panel to the sheet adjacent to the left edge portion, a right fastener group positioned in the right margin of the panel to fasten the right margin of the panel to the sheet adjacent to the right edge portion, and a bottom fastener group positioned in the end margin of the panel; and the panel is selectively retainable in an open position by fastening the bottom fastener group to the top connector group.

9. A shower curtain as set forth in claim 6 wherein:

each fastener connector of the plurality of fastener connectors comprises a slide fastener connector; and each fastener of the plurality of fasteners comprises a slide fastener.

10. A shower curtain as set forth in claim 3 wherein the opening has a width of 30 inches to 40 inches and a height of 20 inches to 30 inches.

11. A shower curtain as set forth in claim 10 wherein the width is 36 inches and the height is 24 inches.

12. A method for using a shower curtain adapted to assist in showering for use in an area including a shower, said area including a shower space sized for receiving a subject for showering and a dry space outside the shower space, said shower curtain comprising (i) a sheet adapted to hang between the shower space and the dry space to limit water exiting the shower space and entering the dry space, the sheet including a foot end and an opening sized and shaped to permit an assistant positioned in the dry space to reach through the opening into the shower space to assist the subject, the opening is defined by an edge including a lower edge portion extending along a bottom of the opening, wherein the lower portion of the edge is spaced 10 inches to 29 inches above the foot end, and (ii) a panel attached to the sheet, the panel being selectively movable between a closed position in which the panel covers the opening to limit water entering the dry space from the shower space and an open position in which the opening is uncovered allowing the assistant to reach through the opening to assist the subject, the panel being selectively retainable in the closed position and selectively retainable in the open position, said method comprising:

guiding the subject from the dry space and into the shower space;

positioning the shower curtain to hang between the shower space and the dry with the panel selectively retained in the closed position;

extending an arm around the shower curtain to turn on the water in the shower space;

moving the panel from the closed position to the open position;

reaching through the opening into the shower space to assist the subject with showering;

moving the panel from the open position to the closed position;

extending an arm around the shower curtain to turn off the water in the shower space;

repositioning the shower curtain to allow movement between the shower space and the dry space; and guiding the subject from the shower space and into the dry space.

13. A shower curtain for use in an area including a showerhead mounted above a bathtub, the area including a wet space containing the showerhead and a portion of the bathtub sized for receiving a subject for showering and a dry space outside the shower space, said shower curtain comprising:

a sheet adapted to separate the wet space from the dry space to limit water entering the dry space from the wet space, the sheet including a foot end and an opening sized and shaped to allow an assistant positioned in the dry space to reach through the opening into the wet space to assist the subject, the opening being defined by an interior edge including a lower edge portion extending along a bottom of the opening and spaced 10 inches to 29 inches above the foot end; and a panel attached to the sheet, the panel being selectively movable relative to the sheet between a closed position in which the panel covers the opening to limit water passing through the opening and an open position in which the opening is uncovered allowing the assistant to reach through the opening to assist the subject, the panel being selectively retainable in the closed position and selectively retainable in the open position.

14. A shower curtain as set forth in claim 13 wherein the panel flexes relative to the sheet allowing the panel to move between the closed position and the open position.

15. A shower curtain as set forth in claim 14 wherein the opening and the panel are generally rectangular.

16. A shower curtain as set forth in claim 15 wherein the panel extends downward from the sheet and is configured to overlap the bottom of the opening, a left side of the opening, and a right side of the opening.

17. A shower curtain as set forth in claim 16 wherein:

the edge defining the opening includes a left edge portion extending along the left side of the opening and a right edge portion opposite the left edge portion extending along the right side of the opening;

the panel has a left margin and a right margin opposite the left margin; and the shower curtain further comprises:

a plurality of fastener connectors including a left connector group positioned on the sheet adjacent to the left edge portion and a right connector group positioned on the sheet adjacent to the right edge portion;

a plurality of fasteners, each fastener of said plurality of fasteners being adapted to connect to each fastener connector of said plurality of fastener connectors, said plurality of fasteners including a left fastener group positioned in the left margin of the panel to fasten the left margin of the panel to the sheet adjacent to the left edge portion and a right group positioned in the right margin of the panel to fasten the right margin of the panel to the sheet adjacent to the right portion.

18. A shower curtain as set forth in claim 17 wherein:

each fastener connector of said plurality of fastener connectors comprises a female magnetic button; and each fastener of said plurality of fasteners comprises a male magnetic button.

19. A shower curtain as set forth in claim 18 wherein:

the panel has a bottom margin;

the plurality of fasteners further includes a bottom fastener group positioned in the bottom margin of the panel;

the plurality of fastener connectors further includes a bottom connector group positioned on the sheet adjacent to the lower edge portion and a top connector group positioned on the sheet adjacent to the upper edge portion; and the panel is selectively retainable in the open position by fastening at least one fastener of the bottom fastener group to at least one fastener connector of the top connector group.

20. A shower curtain as set forth in claim 17 wherein:

each fastener connector of the plurality of fastener connectors comprises a slide fastener connector; and each fastener of the plurality of fasteners comprises a slide fastener.

* * * * *